US010672581B2

(12) United States Patent
Durth

(10) Patent No.: US 10,672,581 B2
(45) Date of Patent: Jun. 2, 2020

(54) TYPE-II OVERVOLTAGE PROTECTION DEVICE

(71) Applicant: PHOENIX CONTACT GMBH & CO. KG, Blomberg (DE)

(72) Inventor: Rainer Durth, Horn-Bad Meinberg (DE)

(73) Assignee: PHOENIX CONTACT GMBH & CO. KG (DE)

( * ) Notice: Subject to any disclaimer, the term of this patent is extended or adjusted under 35 U.S.C. 154(b) by 0 days.

(21) Appl. No.: 15/379,857

(22) Filed: Dec. 15, 2016

(65) Prior Publication Data

US 2017/0178855 A1 Jun. 22, 2017

(30) Foreign Application Priority Data

Dec. 16, 2015 (DE) ..... 10 2015 225 376

(51) Int. Cl.
*H01H 85/00* (2006.01)
*H01C 7/12* (2006.01)
(Continued)

(52) U.S. Cl.
CPC ..... *H01H 85/0039* (2013.01); *H01C 7/102* (2013.01); *H01C 7/12* (2013.01);
(Continued)

(58) Field of Classification Search
CPC ..... H01C 7/102; H01C 7/12; H01C 7/123; H01H 85/0039; H01H 85/04;
(Continued)

(56) References Cited

U.S. PATENT DOCUMENTS 6,285,274 B1 * 9/2001 Gunchenko ..... H01C 7/123 338/21
8,780,521 B2 * 7/2014 Xu ..... H01C 7/10 361/124
(Continued)

FOREIGN PATENT DOCUMENTS

DE 10 2005 048 003 A1 4/2007
DE 10 2006 052 955 A1 3/2008
(Continued)

OTHER PUBLICATIONS

German Search Report prepared by the German Patent Office dated Aug. 12, 2016, for German Patent Application No. 10 2015 225 376.7.
(Continued)

*Primary Examiner* — Jacob R Crum
(74) *Attorney, Agent, or Firm* — Sheridan Ross P.C.

(57) ABSTRACT

The invention relates to a type-II overvoltage protection device having a varistor and a protective element, wherein the protective element has a first contact for connecting to a first potential of a supply network and a second contact that is connected to a first contact of the varistor, wherein the varistor further comprises a second contact for connecting to a second potential of a supply network, wherein the protective element has a fuse element that connects the first contact and the second contact of the protective element, wherein the protective element further comprises a third contact that is connected to the second contact of the varistor and is arranged so as to be near to but electrically insulated from the fuse element, wherein the fuse element has a constriction in the proximity of the neighboring contact, with the constriction being embodied such that the fuse element has an electrically conductive fluxing agent in the proximity of the constriction, with the fluxing agent having a lower fusion point than the fuse element itself, so that pulses correspond-
(Continued)

ing to a load below the type-II rating do not result in a lasting change in the constriction, wherein the constriction, in conjunction with the fluxing agent, is dimensioned such that pulses corresponding to the limit range of the type-II rating result in the fusing of the fluxing agent into the fuse element, and wherein pulses corresponding to a load that is stronger and/or of greater duration than the type-II rating of the varistor result in the immediate disconnection of the fuse element.

14 Claims, 9 Drawing Sheets

(51) Int. Cl.

| | |
|---|---|
| ***H01H 85/38*** | (2006.01) |
| ***H01C 7/102*** | (2006.01) |
| ***H01T 1/14*** | (2006.01) |
| ***H01H 85/04*** | (2006.01) |
| ***H01H 85/143*** | (2006.01) |
| ***H01H 85/20*** | (2006.01) |

(52) U.S. Cl.
CPC ..... *H01C 7/123* (2013.01); *H01H 85/04* (2013.01); *H01H 85/143* (2013.01); *H01H 85/20* (2013.01); *H01H 85/38* (2013.01); *H01T 1/14* (2013.01)

(58) Field of Classification Search
CPC ..... H01H 85/08–11; H01H 85/143; H01H 85/20; H01H 85/38; H01T 1/14
USPC ..... 337/283
See application file for complete search history.

(56) References Cited

U.S. PATENT DOCUMENTS

| | | | | |
|---|---|---|---|---|
| 2001/0055187 | A1* | 12/2001 | McLoughlin | H01C 7/126 361/127 |
| 2010/0176910 | A1* | 7/2010 | Knab | H01H 37/761 337/290 |
| 2012/0086540 | A1* | 4/2012 | Duval | H01H 37/761 337/1 |
| 2014/0285941 | A1* | 9/2014 | Xu | H01C 7/126 361/127 |
| 2015/0235798 | A1* | 8/2015 | Takamura | H01H 85/06 337/295 |
| 2016/0125983 | A1* | 5/2016 | Hsu | H01C 1/144 338/21 |

FOREIGN PATENT DOCUMENTS

| | | | |
|---|---|---|---|
| DE | 10 2011 014 343 | A1 | 9/2012 |
| DE | 10 2014 215 280 | B3 | 9/2015 |
| DE | 10 2014 215 279 | A1 | 2/2016 |
| FR | 2 758 420 | A1 | 7/1998 |

OTHER PUBLICATIONS

Decision to Grant prepared by the German Patent Office dated Dec. 1, 2016, for German Patent Application No. 10 2015 225 376.7.

* cited by examiner

TYPE-II OVERVOLTAGE PROTECTION DEVICE

CROSS-REFERENCE TO RELATED APPLICATIONS

This application claims the benefit of German Patent Application No. DE10 2015 225 376.7 filed Dec. 16, 2015, the contents of which are incorporated herein in their entirety by reference.

BACKGROUND

It is known that electrical surges in devices can have a multitude of causes.

The energy content associated with the respective overvoltage event varies greatly. It must generally be assumed, however, that overvoltage events with high energy contents are rarer than overvoltage events with low energy contents.

For example, overvoltage events with low energy contents, such as in the case of excess voltage due to switching actions, occur with far greater frequency than overvoltage events with high energy contents, such as the direct or indirect effects of lightning.

In order to render these overvoltage events less hazardous, overvoltage protection devices have been developed that are designed to divert the respective voltage surges.

However, the performance of the overvoltage protection devices also requires commensurate use of materials, so particularly effective overvoltage protection devices also come at substantial cost.

Type-I overvoltage protection devices (according to DIN EN 61643-11; previously called B-arresters according to DIN VDE 0675 part 6) are supposed to be used when high lightning currents may be coupled in.

By using type-I overvoltage protection devices, potential equalization can be established between the PE outer conductor and the neutral conductor at the time of the lightning strike. These type-I overvoltage protection devices are used in main power supply systems. This is intended to ensure that the lightning current is not able to flow into the building installation. Type-I overvoltage protection devices are supposed to operate below the rated impulse voltage of 6 kV permitted for the equipment in the feed (DIN VDE 0110 part 1/November 2003).

Type-I overvoltage protection devices generally cannot protect the entire low-voltage installation along with the terminal equipment, since the terminal equipment can be far removed and have a lower rated impulse voltage. This task is performed by overvoltage protection devices of type II (type-II overvoltage protection device according to DIN EN 61643-11; previously C-arrester according to DIN VDE 0675 part 6) and type III (type-III overvoltage protection device according to DIN EN 61643-11; previously D-arrester according to DIN VDE 0675 part 6).

Since type-I overvoltage protection devices are very expensive, a trend has developed in locations without lightning exposure to dispense with expensive type-I arresters in favor of substantially cheaper type-II arresters.

Type-II arresters are made primarily on the basis of high-performance "B40" varistor ceramic discs (edge length approx. 40 mm×40 mm). These have a rated discharge capacity $I_{rated}$ of about 20 kA of the 8/20-μs pulse form. Substantially higher loads result in the destruction of the arrestors.

However, the limited overvoltage protection on type-II arresters has the disadvantage that direct or nearby strikes result in pulse currents that far exceed the capacity of the type-II arrester both in terms of peak current amplitude and pulse length, resulting in its destruction.

While type-II arresters are equipped with safety mechanisms against excess heating and aging, the pulse-like overloading (of a few milliseconds) often leads to the complete destruction of the arrester.

The cause for this is that, while the corresponding backup fuse(s) are tripped in the case of larger pulse currents and thus prevent subsequent line currents from passing through overloaded arresters, the pulse current itself is not stopped, so the arrester can be overloaded without restriction.

Furthermore, the safety mechanisms of the arrester are essentially based on heat-activated mechanisms which, due to their own thermal inertia, are not tripped until after at least 100 ms.

There is consequently no effective protection against overvoltage events of excessive amplitudes and longer duration, such as long-wave pulses as a consequence of distant strikes.

Besides the pulse-like destruction of the conventional type-II arrester, this also results in direct damage in the proximity of the arrester in question in the form of mechanical destruction, metal vapor, and soot-like contamination, as well as secondary damage resulting from open electric arcs and aftereffects thereof, such as the igniting of materials that are within range.

OBJECT OF THE INVENTION

It would therefore be desirable to be able to provide a cost-effective type-II overvoltage protection device that is capable of safely diverting even overvoltage events commensurate with those from a lightning strike.

BRIEF DESCRIPTION OF THE INVENTION

The object is achieved by a type-II overvoltage protection device having a varistor and a protective element, wherein the protective element has a first contact for connecting to a first potential of a supply network and a second contact that is connected to a first contact of the varistor, wherein the varistor further comprises a second contact for connecting to a second potential of a supply network, wherein the protective element has a fuse element that connects the first contact and the second contact of the protective element, wherein the protective element further comprises a third contact that is connected to the second contact of the varistor and is arranged so as to be near to but electrically insulated from the fuse element, wherein the fuse element has a constriction in the proximity of the neighboring contact, with the constriction being embodied such that the fuse element has an electrically conductive fluxing agent in the proximity of the constriction, with the fluxing agent having a lower fusion point than the fuse element itself, so that pulses corresponding to a load below the type-II rating do not result in a lasting change in the constriction, and wherein the constriction, in conjunction with the fluxing agent, is dimensioned such that pulses corresponding to the limit range of the type-II rating result in the fusing of the fluxing agent into the fuse element.

Other advantageous embodiments of the invention are indicated in the subclaims and the description.

BRIEF DESCRIPTION OF THE DRAWINGS

In the following, the invention is explained in further detail with reference to the enclosed drawing on the basis of preferred embodiments.

DETAILED DESCRIPTION

Figure 1:
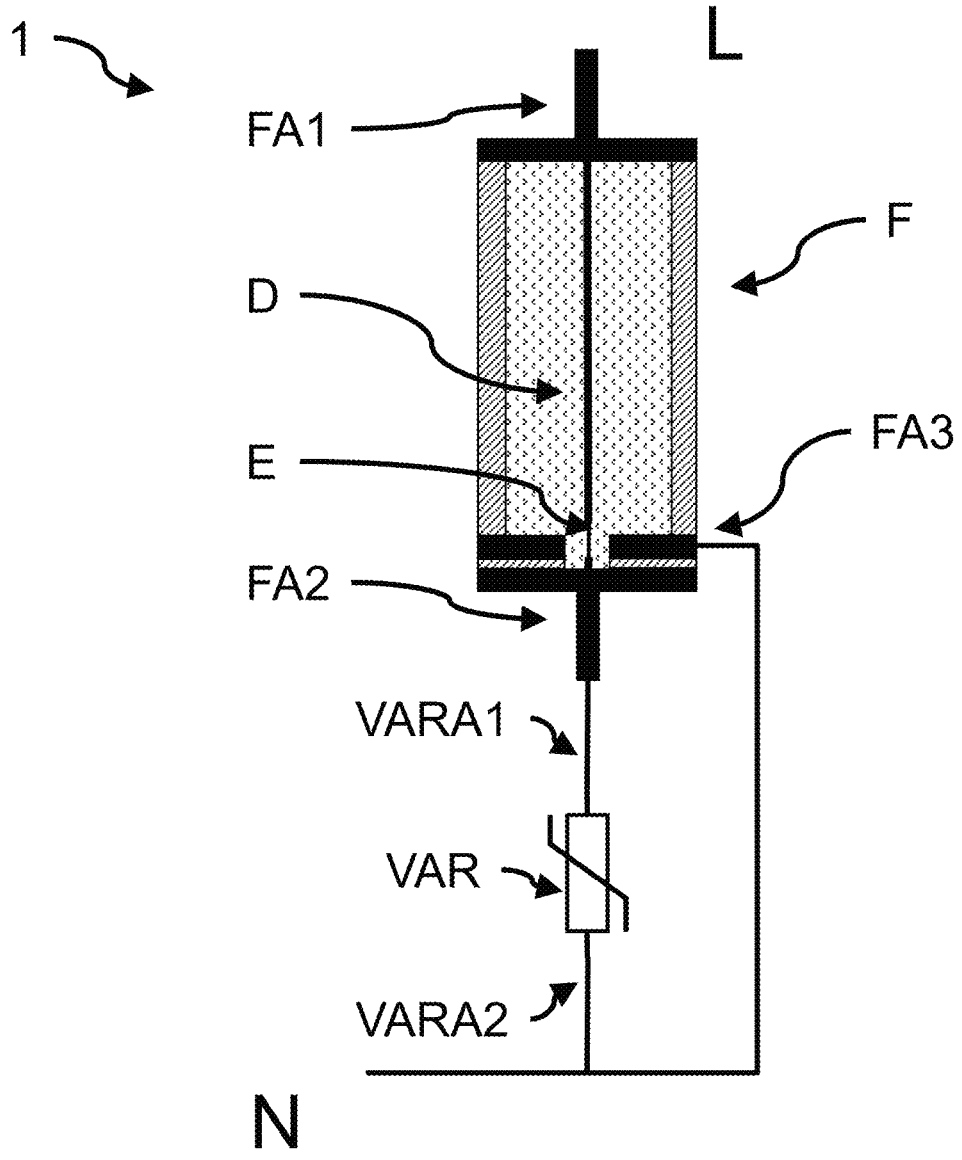
FIG. 1 shows a schematic representation of an overvoltage protection device according to the invention.

The invention is explained in further detail below with reference to the figure. It should be noted that different aspects are described, each of which can be utilized individually or in combination. That is, any aspect can be used with different embodiments of the invention, provided that it is not portrayed explicitly as a mere alternative.

Moreover, for the sake of simplicity, reference will generally be made in the following to only one entity. Insofar as not noted explicitly, however, the invention can also have several of the entities concerned. Therefore, the use of the words "a," "an," "of a" and "of an" is to be understood only as an indication to the effect that at least one entity is used in a single embodiment.

Even though reference is made in the following to phases N, L of an alternating-current network, the invention is not limited to this, but can be used in any configuration of an electrical supply network, whether in the form of a direct-current network or a single-phase or multi-phase alternating-current network.

In its most general form, a type-II overvoltage protection device 1 according to the invention has at least one varistor VAR and one protective element F. In the interest of better understanding, contacts on these elements will be described below. The protective element F has a first contact FA1 for connecting to a first potential L of a supply network and a second contact FA2 that is connected to a first contact VARA1 of the varistor VAR.

The varistor VAR further comprises a second contact VARA2 for connecting to a second potential N of a supply network.

The protective element F has at least one fuse element D that connects the first contact FA1 and the second contact FA2 of the protective element F.

Moreover, the protective element F has a third contact FA3 that is connected to the second contact VARA2 of the varistor VAR and that is arranged so as to be near to but electrically insulated from the fuse element D.

The significance of proximity will be explained in further detail later.

Near the neighboring contact FA3, the fuse element D has a constriction E, with the constriction E being embodied such that the fuse element D has an electrically conductive fluxing agent SM near the constriction E, with the fluxing agent SM having a lower fusion point than the fuse element D itself, so that pulses corresponding to a load below the type-II rating do not result in a lasting change in the constriction E, with the constriction E in conjunction with the fluxing agent SM being dimensioned such that pulses corresponding to a load in the limit range of the type-II rating result in the fusing of the fluxing agent SM into the fuse element D, and with pulses corresponding to a load that is greater and/or of longer duration than the type-II rating of the varistor VAR resulting in the immediate disconnection of the fuse element D.

As a result of the fact that the constriction E, in conjunction with the fluxing agent SM, is dimensioned such that pulses corresponding to a load in the limit range of the type-II rating, result in the fusing of the fluxing agent SM into the fuse element D, it is ensured that the constriction E always ages more quickly than the varistor VAR itself.

Preferably, the protective element F is arranged in a pressure-tight and/or insulating housing.

What is essential, however, is the energetic coordination and configuration of the constriction E of the fuse element D with respect to the rating of the varistor VAR to be protected.

In this first embodiment of the system, the constriction E of the fuse element D is dimensioned such that the constriction E can only bear $I^2t$ values of pulse amplitudes without changing that do not result in relevant aging of the downstream varistor VAR. Greater overvoltage pulses, in contrast, result in the changing of the constriction. Two cases must be differentiated here.

$I^2t$ characteristic curves and $I^2t$ values stand for the thermal effect of the current which trips the fuse. $I^2t$ values are true physical fuse data that depend on the construction of the fuse.

In the first case, the overload is so great that the constriction E is so thermally overloaded that the fuse element fuses at the constriction E and an electric arc is produced which, in turn, commutates to the third supplied contact FA3 in the proximity of the constriction E, so that the overloaded varistor VAR is electrically discharged, and the main fuse element D of the fuse is tripped, the current discharged and the varistor VAR disconnected from the network. The varistor VAR is thereby released from the arc integral of the protective element F and ultimately disconnected in a securely insulated manner from the network.

In the second case of overload, the level of the overloading of the varistor VAR moves within a range in which the varistor VAR is not directly destroyed but an alteration of its electrical characteristics can be expected. Such overloads result in an alteration of characteristic and performance data of the varistor VAR, so that subsequent discharges can lead to an overload, or the insulating ability of the varistor VAR can diminish, for example. For varistors VAR, these processes are subsumed under the term "aging." In order to enable the aging of the varistor VAR to be identified by technical means, additional measures are required.

To this end, the fuse element D has an electrically conductive fluxing agent SM in the proximity of the constriction. The electrically conductive fluxing agent SM diffuses into the fuse element upon heating and reduces its conductivity. Since the electrically conductive fluxing agent SM is arranged in the proximity of the constriction, due to the fact that greater electrical resistance is now present here, commensurately faster heating can be expected.

This technique enables improved tripping of the protective element F. Through the appropriate dimensioning, choice of material, and geometry of the constriction, as well as the targeted influencing of the impact duration of the temperature, the aging process of the constriction E in relation to the aging of the varistor VAR as a result of discharged overvoltage can be set such that the pulse load capacity of the constriction E is always below the residual pulse load capacity of the varistor VAR. Pulse events that lie above the "residual discharge capacity" of the varistor therefore always result in the tripping of the protective element F and to the releasing of the varistor VAR from the switch-off integral of the fuse.

A type-II overvoltage protection device is thus provided that can withstand a one-time high-energy pulse (one-time because it is very rare) without any destruction of any kind occurring outside of the varistor VAR. Since such a device complies with performance class I one single time, it can be regarded as a typed I arrester with a type-I backup.

The subsequent loss of the overvoltage protection device is consciously accepted in order to make a reliable and yet cost-effective overvoltage protection device available.

While the overvoltage protection device according to the invention does not meet the requirement placed on customary type-I arresters in terms of "multiple discharges," it is on par with them in terms of a one-time maximum loading and is correspondingly secure.

A practical overvoltage protection device is thus provided that makes the usual lasting type-II overvoltage protection available to non-exposed electrical systems, protects them against pulse overloading and, at the same time, guarantees one-time protection of the system from lightning strike events.

The system availability is maintained even in the event that the overvoltage protection device according to the invention is activated, since upstream fuse elements in the main current path are not destroyed.

Such an overvoltage protection device according to the invention can be regarded as secure basic overvoltage protection for broad application.

In one advantageous embodiment, upon discharging of a pulse corresponding to a type-I pulse event, the constriction E and the fluxing agent SM are configured such that the constriction E immediately disconnects and the resulting electric arc commutates to the third contact.

As a result, the varistor VAR is immediately discharged. The protective element F is dimensioned with respect to its energy absorption capacity that it is possible to discharge a pulse event analogously to a type-I arrester ONE TIME. That is, a high-energy event such as a lightning strike can be discharged once.

Figures 2A, 2B:
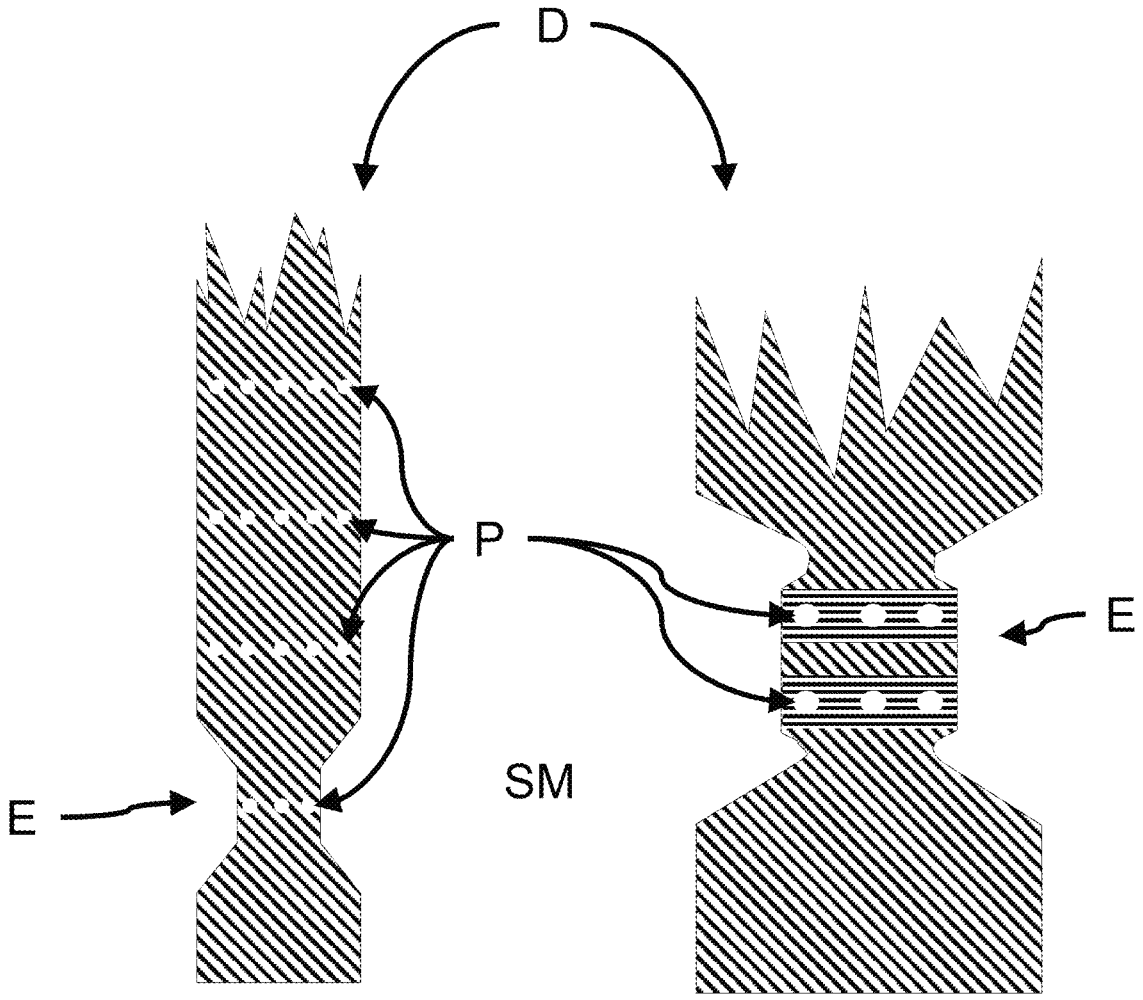
FIG. 2*a* shows one aspect of the invention.
FIG. 2*b* shows another aspect of the invention.

In one advantageous embodiment. which is shown in FIGS. 2*a* and 2*b*, the fuse element has, at least in the proximity of the constriction E—as shown in FIG. 2*a*—a perforation (or series of perforations) P or—as shown in FIG. 2*b*—several perforations (or series of perforations) P. Suitable perforations can of course also be arranged in other locations on the fuse element D, as can be seen from FIG. 2*a*, for example. The structure of the perforation P is circular only for the sake of example. It can also take on other shapes.

It is particularly advantageous if the constriction E has a perforation in which the fluxing agent SM is located. The process of diffusion into the fuse element D can thus be accelerated. The diffusion causes the electrical resistance to change (increase), thereby increasing local heat transformation and promoting prompt disconnection.

In another embodiment of the invention, an additional provision can be made that the protective fuse element F further comprises a fourth contact FA4 that is connected via a heat-activated switch S to the second contact VARA2 of the varistor VAR and arranged adjacent to the fuse element D, with the heat-activated switch S being thermally connected to the varistor VAR.

In the figures, the proximal relationship of this fourth contact FA4 is clarified by an arrow. Different mechanisms can be used for this purpose. For example, it is possible to embody the fourth contact FA4 so as to be electrically insulated in relation to the fuse element D. It is also possible, however, for a slight conductivity to be present here between the fourth contact FA4 and the fuse element D to improve ignition or for an auxiliary fuse element (not shown) to be provided between the fourth contact FA4 and the first contact FA1.

Figure 3:
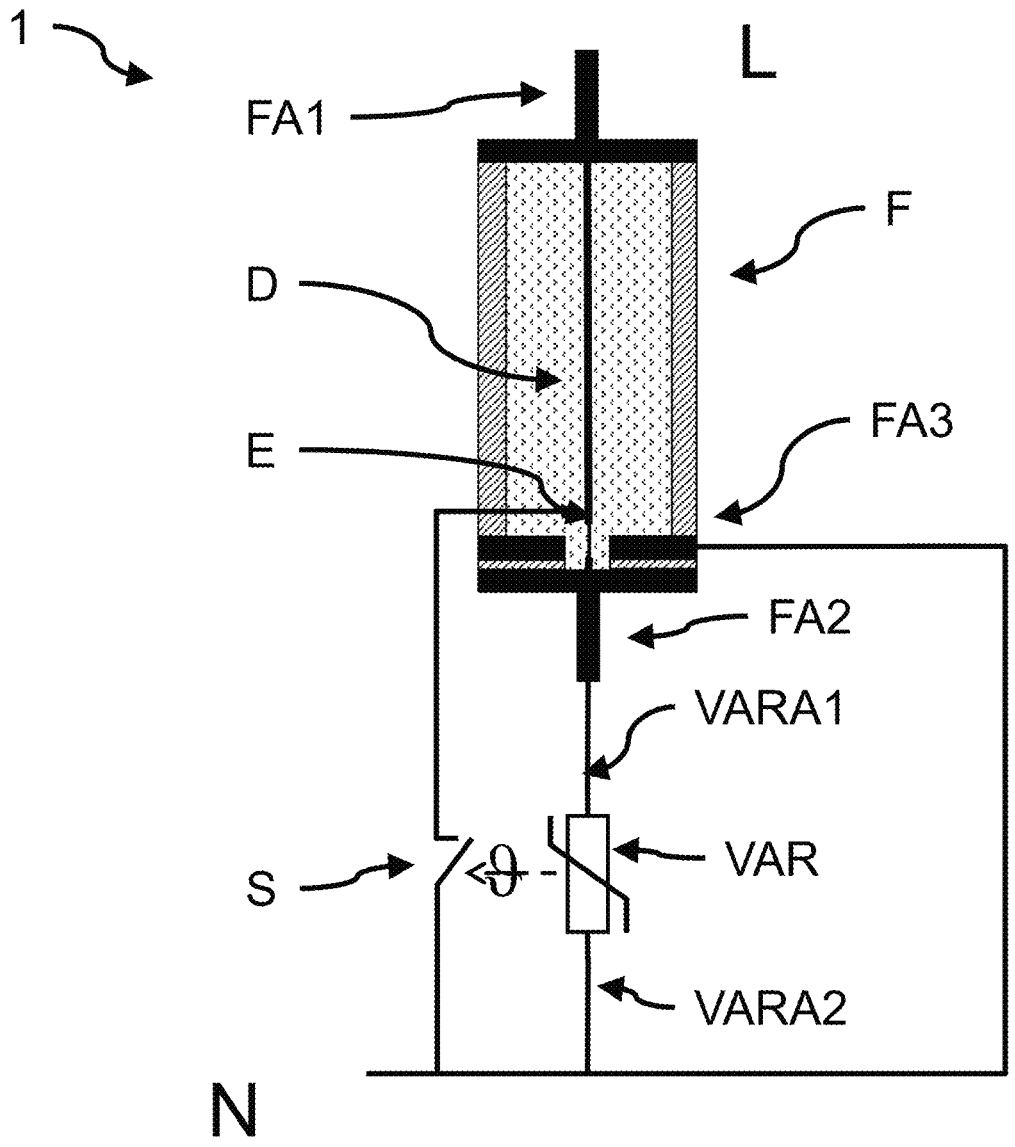
FIG. 3 shows a schematic representation of another embodiment of an overvoltage protection device according to the invention, FIGS. 4*a-d* each show a schematic representation of another embodiment of an overvoltage protection device according to the invention.

In other words, in the embodiment of FIG. 3, another kind of aging of the varistor VAR can also be identified; after all, cases are known in which the varistor VAR has become so damaged/aged in terms of its insulation that leakage currents flow and bring about a permanent heating of the varistor VAR. The flowing current can be in the range of less than one to several tens of milliamperes and would frequently remain undetected.

Conventional varistor arresters are equipped with disconnecting devices for this purpose that establish electrical contact to the varistor via a spring-biased solder joint. In the event of an overload or impermissible permanent heating, the temperature of the varistor rises far enough for the solder joint to soften and the spring bias to interrupt the electrical contact.

These systems are very limited in terms of reliable function over a broader current range. On the one hand, the contact point has to have such a robust design that it withstands the magnetic forces and the heating during normal discharging activity, while on the other hand the system has to be thermally sensitive enough that the thermal disconnection occurs in timely fashion before a varistor fuses and high short-circuit currents begin flowing. These conflicting objectives can generally only be reconciled to a limited extent.

These systems have further limitations due to the simple mechanical design of two disconnecting contacts. These systems usually have very limited switching capability, so larger currents can no longer be switched off and a constant electric arc is formed that can lead to the (external) destruction of the varistor.

Therefore, as shown in FIG. 3, a heat-sensitive switch S, that is, a bimetallic switch (normally-open contact) is proposed which, upon reaching a maximum permissible temperature, the neutral conductor potential N switches to the fourth contact FA4, so that a first electric arc occurs between fuse element D and fourth contact FA4 that ignites the main electric arc between fuse element D and neutral conductor contact and consequently damages the fuse element D, thereby resulting in the complete tripping of the protective element F. As a result, the defective varistor VAR is securely separated and isolated from the network.

The heat-sensitive switch S can of course also be constructed by means of thermally nonlinear resistors or the like; indeed, no limitations are imposed in the person skilled in the art in this respect.

Figure 4A:
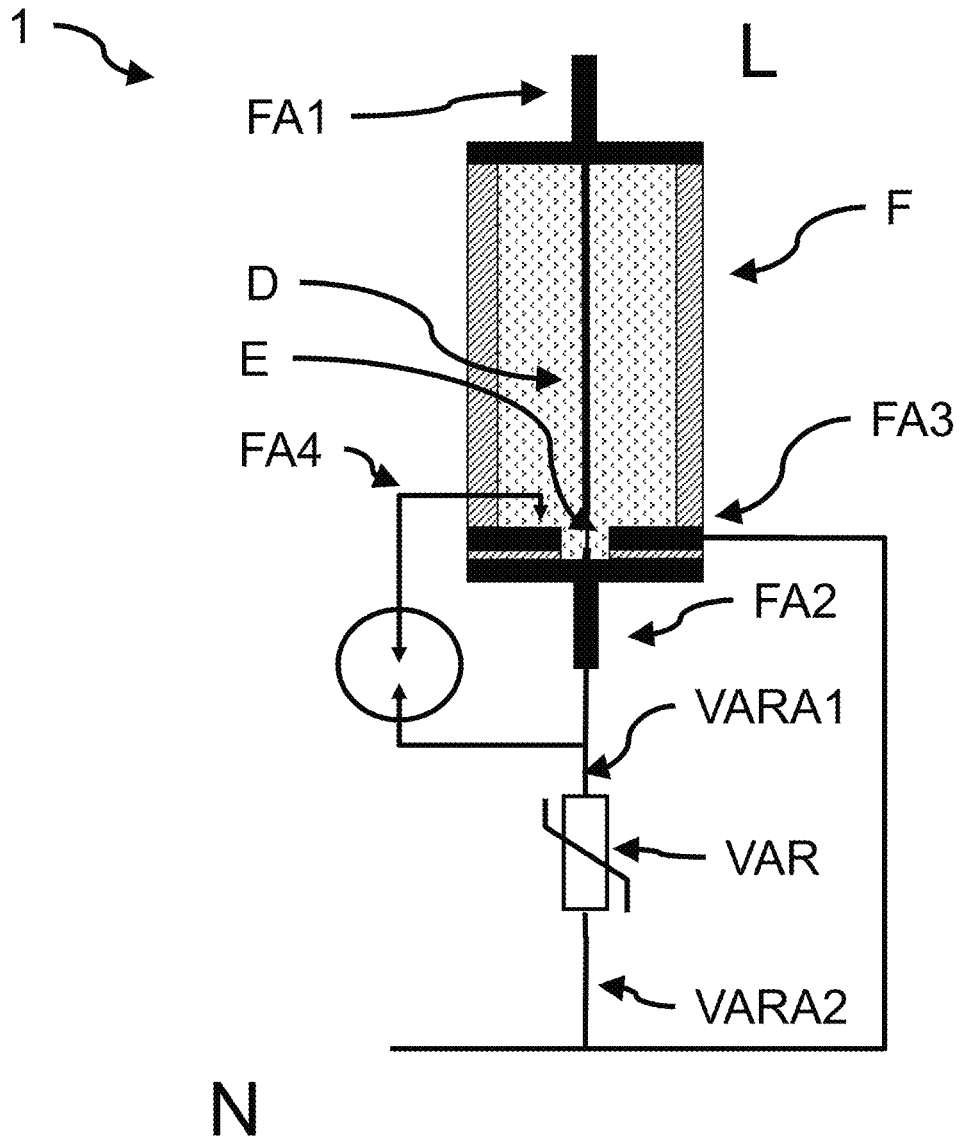
Figure 4B:
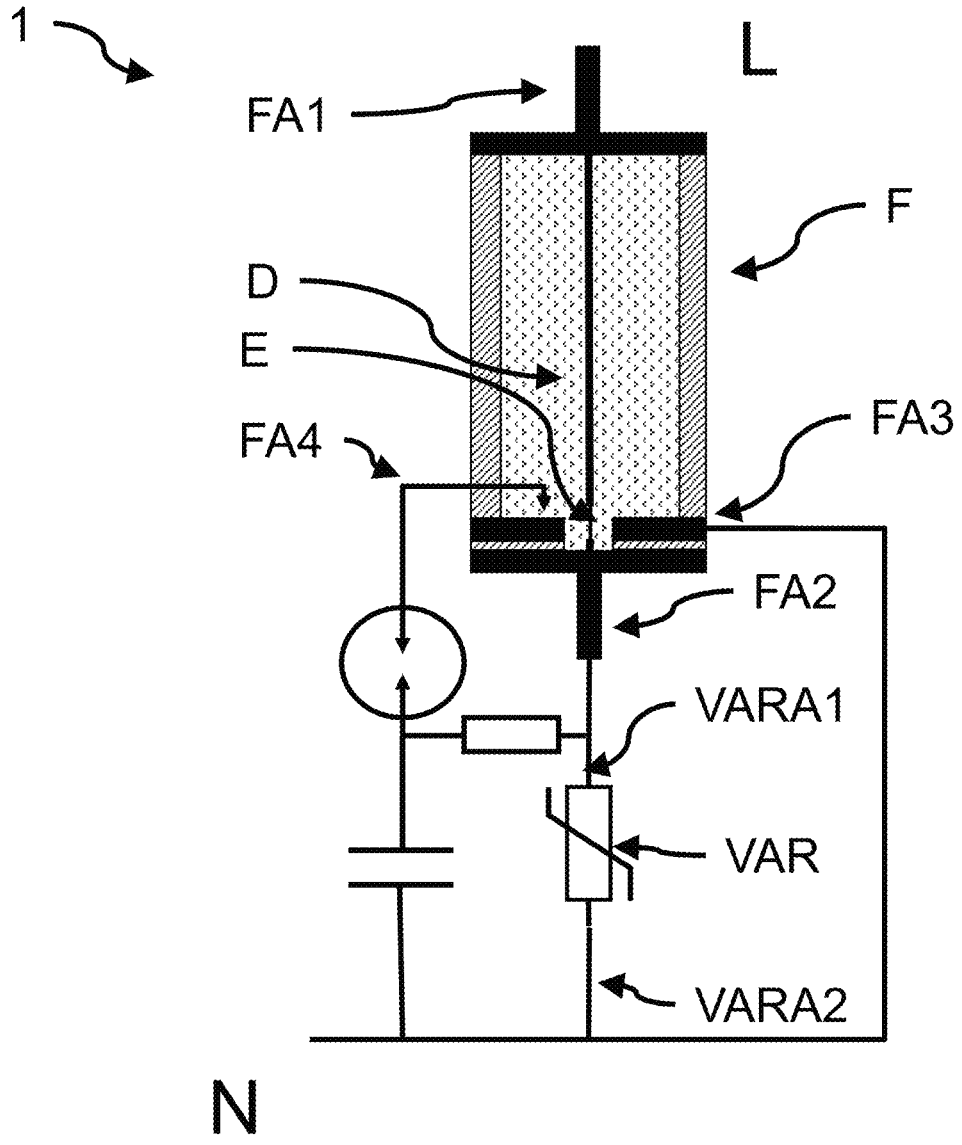
Figure 4C:
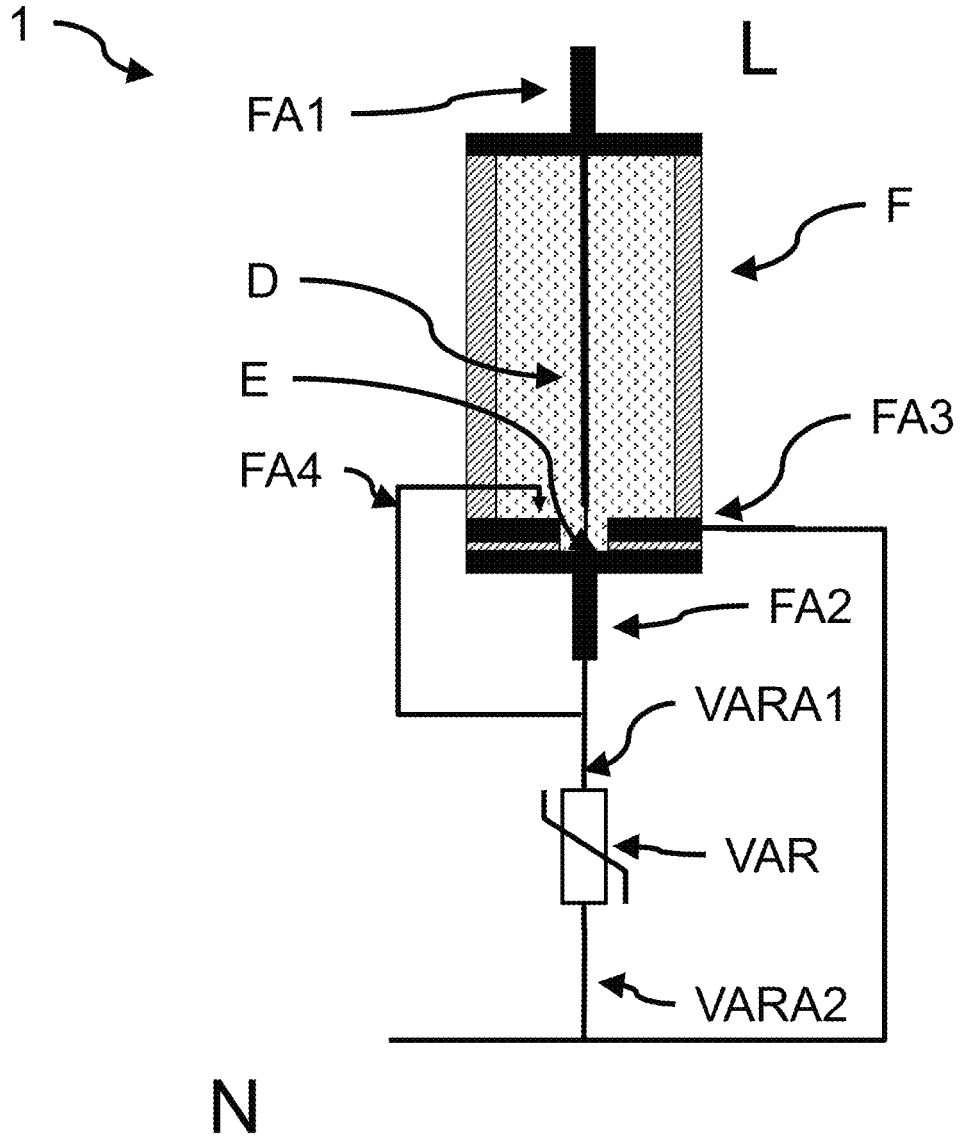

In the other embodiments illustrated in FIGS. 4*a-c*, a provision can also be made alternatively or in addition to the previous embodiments that the protective element F has a fourth contact FA4 that is connected to the first contact VARA1 of the varistor VAR and arranged adjacent to the fuse element D and near to but electrically insulated from the third contact FA3.

These variants make it possible to use the voltage at the varistor as a controlling means, so that a (dynamic) overcurrent causes the fuse element to switch as already described above. This type of overload detection identifies the voltage that drops across the varistor VAR. In varistors, there is an unambiguous and constant rising correlation of the voltage with the flowing current, even if the corresponding characteristic curve is highly nonlinear. The characteristic curve therefore allows one to identify when the maximum permissible (dynamic) current has been exceeded for the corresponding type of varistor. The analogously detected signal can be used to ignite the tripped fuse.

In the embodiment of FIGS. 4*a* and 4*b*, an overvoltage-sensitive element TVS is arranged between the fourth contact FA4 of the protective element F and the first contact VARA1 of the varistor VAR.

The circuit shown in FIG. 4*a* discloses an overvoltage arrester as a voltage-detecting element TVS that is also a switching element (SPD) at the same time. Through the ignition of the overvoltage arrester, the protective element F is triggered and tripped via the fourth contact. This kind of protection of the varistor VAR before overloading takes effect when very quick overload events occur as a result of pulse currents with very quick wave-front durations.

As a rule, this type of overload cannot be detected in time by means of thermal monitoring mechanisms.

The overvoltage-sensitive elements TVS can be implemented, for example, by a spark gap, a transient voltage suppressor diode, a gas-filled surge protector SPD, or another varistor (with a different characteristic curve) or the like.

An additional provision can be readily made that, in addition to the overvoltage-sensitive element TVA, lowpass-forming elements are provided. These can be provided through appropriate wiring using resistors and/or capacitors and/or coils.

Figure 4D:
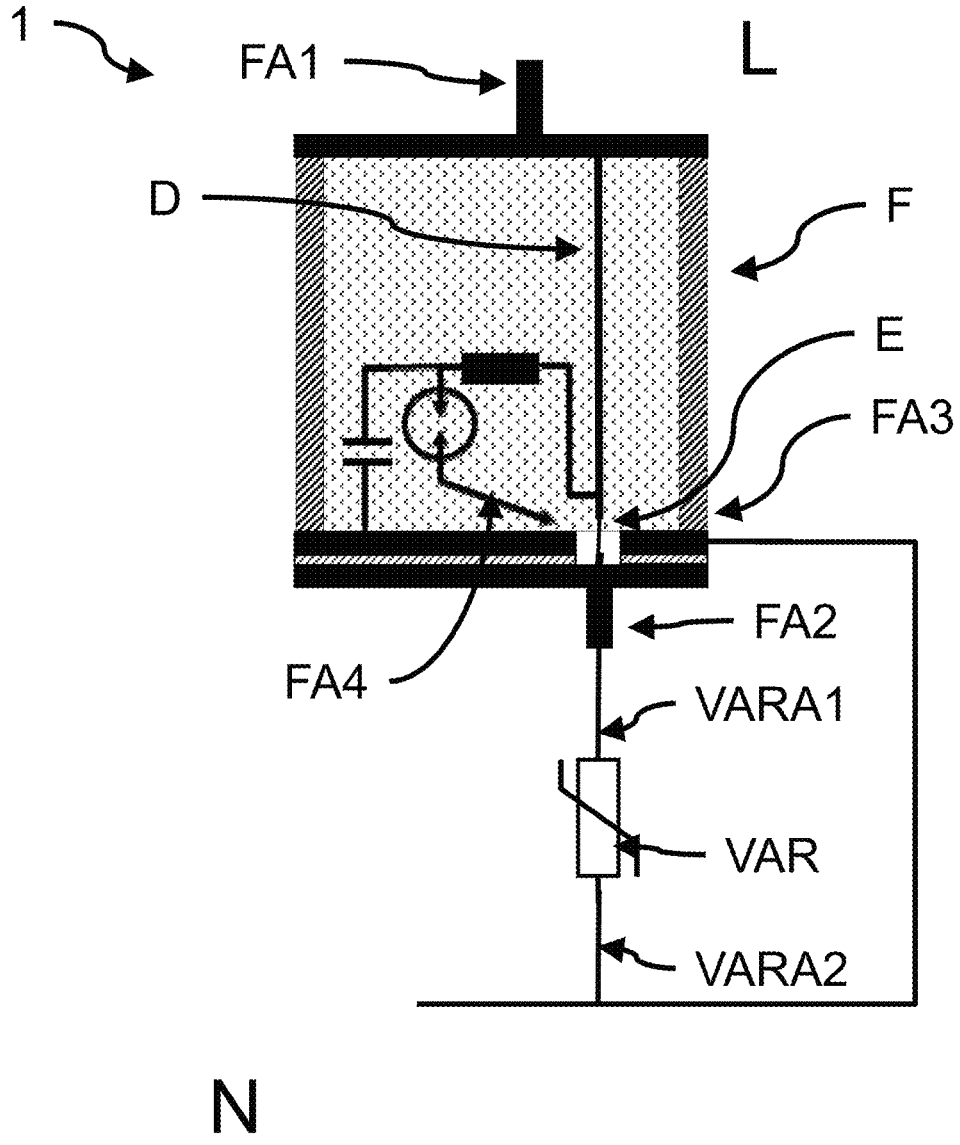

Alternatively or in addition, however, the voltage at the fuse element D (as shown in FIG. 4*d*) can be used as a controlling means.

In FIG. 4*d*, for example, an overvoltage-sensitive element TVS is arranged within the fuse element F, with the overvoltage-sensitive element TVS being connected on one side electrically to the fuse element between the first contact FA1 and the constriction E, and with the other side of the overvoltage-sensitive element TVS being in the proximity of the fuse element D and near to but electrically insulated from the third contact FA3.

The overvoltage-sensitive elements TVS can be implemented, for example, by a spark gap, a transient voltage suppressor diode, a gas-filled surge protector SPD, or another varistor (with a different characteristic curve) or the like.

An additional provision can be readily made that, in addition to the overvoltage-sensitive element TVA, lowpass-forming elements are provided. These can be provided through appropriate wiring using resistors and/or capacitors and/or coils.

The overvoltage-sensitive element TVS can be arranged both in its own pressure-tight housing (not shown) in order to prevent or minimize damage in the event of possible destruction, or the overvoltage-sensitive element TVS can also be arranged in the pressure-tight housing of the protective element F, as shown in FIG. 4*d*.

Figure 6:
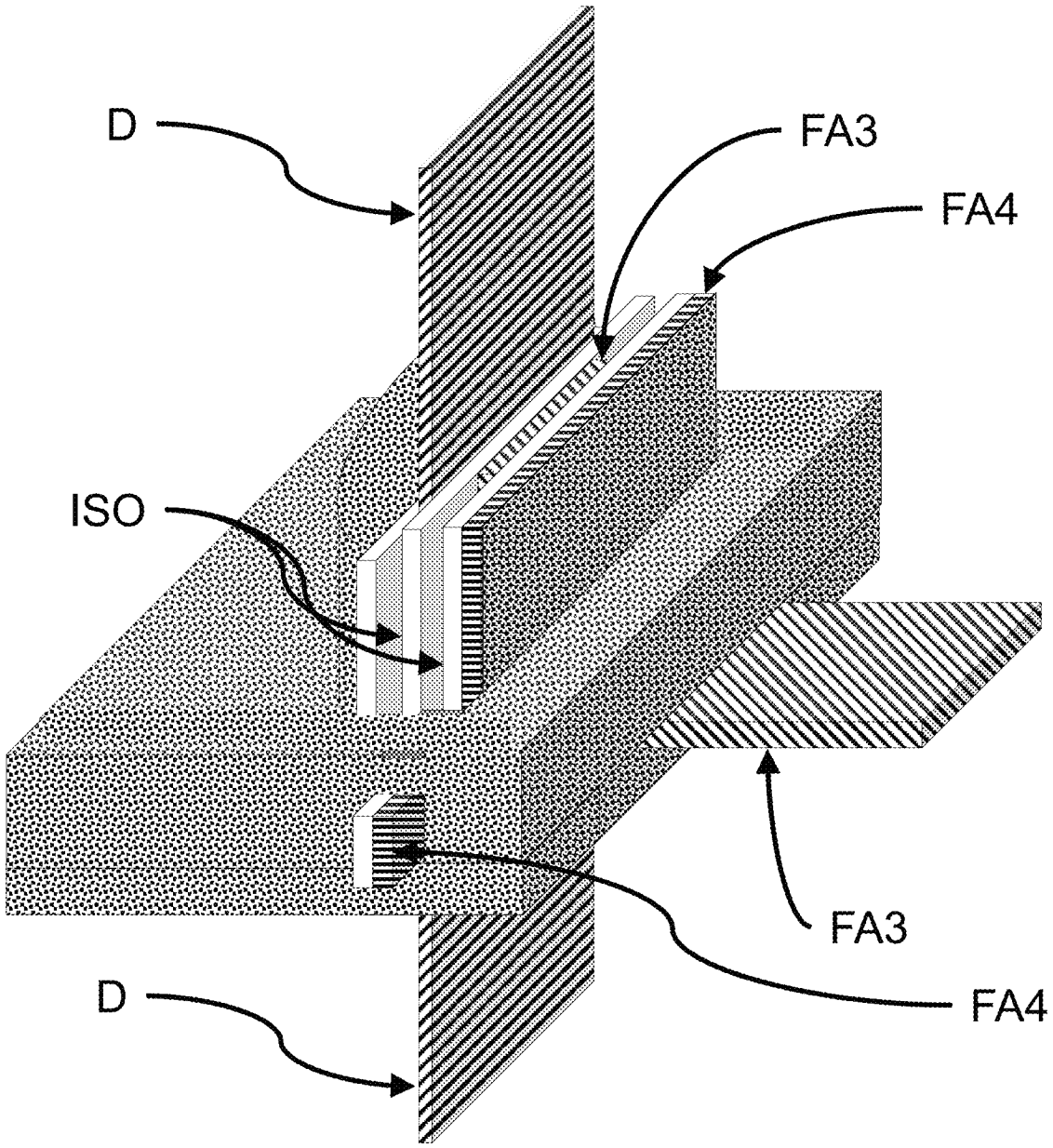
FIG. 6 shows an exemplary configuration of contacts and fuse elements according to embodiments of the invention.

What is more, a provision can be made in the various embodiments that the fuse element D and the third contact FA3 of the fuse element F are electrically separated in the normal operating state by an insulating material ISO, in which case the third contact and the insulating material ISO are arranged such that an ignition near the insulating material ISO results in an at least superficial degradation of the insulating material ISO, whereby the surface loses its insulating property and allows current to flow between the fuse element D and the third contact FA3. Such an embodiment is shown in FIG. 6. The fuse element D (shown with longitudinal hatching) is shown without constriction E. The fuse element D is separated from the third contact FA3 (shown with oblique hatching) by an insulating material ISO (shown as a white layer). Moreover, a fourth contact FA4 (shown with cross-hatching) can be optionally provided, it being possible for the third contact and the fourth contact FA4 to be separated by a (similar or different) insulating material ISO. If a fourth contact FA4 is made available in addition to the third contact FA3, the sequence can also be set up differently—that is, the fourth contact FA4 can also be arranged adjacent to the fuse element D. The different contacts FA3, FA4 and the fuse element D can be manufactured as thin metal films or plates, for example. The various elements can be contained inside an insulating enclosure (shown as a dotted line).

In the event of triggering by means of the third contact FA3 or fourth contact FA4 (if present), an electric arc occurs toward the fuse element D that damages the insulating material ISO located in the vicinity (between D and FA3), so that the insulating material ISO, due to its low CTI value (CTI value of FR4 of about 150 V, for example) and the (local superficial) degradation caused by the electric arc (for example, sooting, charring), now causes a (small) electric arc to continue to be maintained (or ignited again even after a zero point of the phase in the case of alternating voltage operation), which "eats" its way starting from the point of origin along the boundary surface (in both directions), thereby ultimately severing the fuse element D.

The insulating material ISO can have a plastic or a composite material with a low CTI value, for example phenol resin (PF resins), polyether ether ketone (PEEK), polyimide (PI), or epoxy resin-filled glass fiber composite materials such as FR4 or the like. CTI values—also known as tracking resistance—are determined according to IEC 60112, for example. Exemplary materials are classified under insulating material group IIIa and/or insulating material group IIIb.

Moreover, a provision can be advantageously made that the protective element F has a filling made of sand at least in the area of the constriction E. In this way, the effect of strong electric arcs can be effectively attenuated.

Figure 5:
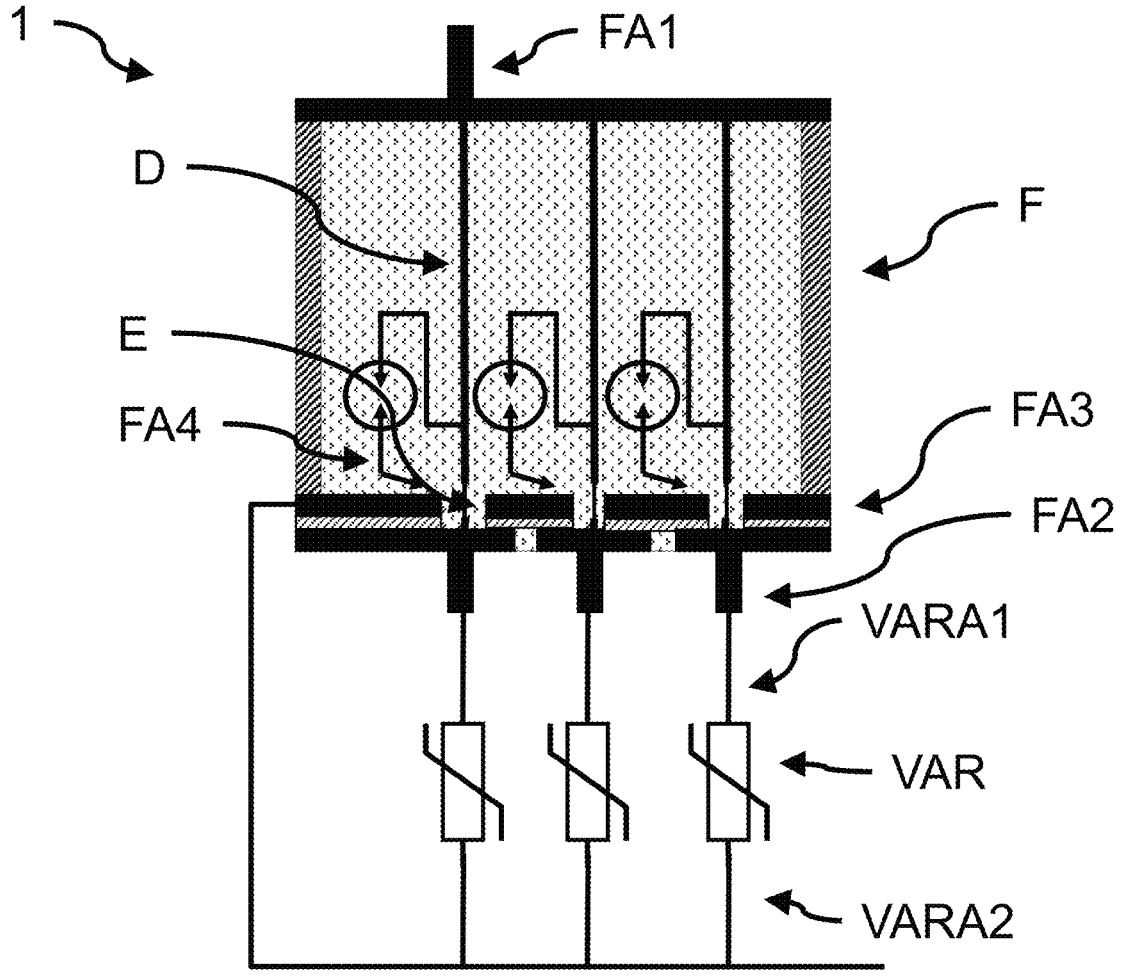
FIG. 5 shows an exemplary current flow in relation to the overvoltage protection device according to the invention in a first, non-operational state of the overvoltage protection device and in a state in which it is connected to a power network.

As can be seen from FIG. 5, for example, the invention can of course also be used for multi-conductor systems, in which case either individual overvoltage protection devices can be used for single phases, or a combination device can be used (as shown).

The overvoltage protection device shown in FIG. 5 therefore offers the advantage that the arrangement of the potentials in one housing not only saves space but that the tripping of a fuse element F also leads to the tripping of all elements. The ensuing overvoltage protection is thus separated from the network in three phases.

The overvoltage protection devices according to the invention can be mounted as-is on a supporting rail and can also have suitable local fault indicators or suitable remote fault indicators in order to signal tripping.

List of Reference Symbols

| | |
|---|---|
| overvoltage protection device | 1 |
| varistor | VAR |
| protective element | F |
| varistor contact | VARA1, VARA2 |

-continued

| List of Reference Symbols | |
|---|---|
| protective element contact | FA1, FA2, FA3, FA4 |
| potential | L, N |
| fuse element | D |
| constriction | E |
| fluxing agent | SM |
| overvoltage-sensitive element | TVS |
| insulating material | ISO |

The invention claimed is:

1. An overvoltage protection device, comprising:

a varistor and a protective element, wherein the protective element has a first contact for connecting to a first potential of a supply network and a second contact that is connected to a first contact of the varistor, wherein the varistor further comprises a second contact for connecting to a second potential of the supply network, wherein the protective element has at least one fuse element that connects the first contact of the protective element and the second contact of the protective element, wherein the fuse element has a constriction in proximity of a third contact of the protective element, with the constriction being embodied such that the fuse element has an electrically conductive fluxing agent in proximity of the constriction, wherein the fluxing agent has a lower fusion point than the fuse element, so that pulses corresponding to a load below a first rating do not result in a lasting change in the constriction, wherein the constriction, in conjunction with the fluxing agent, is dimensioned such that pulses corresponding to a load in a limit range of the first rating result in the fusing of the fluxing agent into the fuse element, wherein pulses corresponding to a load that is stronger and/or of greater duration than the first rating result in an immediate disconnection of the fuse element.

2. The overvoltage protection device as set forth in claim 1, wherein the constriction and the fluxing agent, upon discharging of a pulse event stronger and/or of greater duration than the first rating, immediately disconnect, and a resulting electric arc commutates to the third contact.

3. The overvoltage protection device as set forth in claim 1, wherein the constriction has a perforation in which the fluxing agent is located.

4. The overvoltage protection device as set forth in claim 1, wherein the protective element further comprises a fourth contact that is connected via a heat-activated switch to the second contact of the varistor and arranged adjacent to the fuse element, with the heat-activated switch being thermally connected to the varistor.

5. The overvoltage protection device as set forth in claim 1, wherein the protective element also has a fourth contact that is connected to the first contact of the varistor and arranged adjacent to the fuse element and near to but electrically insulated from the third contact.

6. The overvoltage protection device as set forth in claim 5, wherein an overvoltage-sensitive element is arranged between the fourth contact of the protective element and the first contact of the varistor.

7. The overvoltage protection device as set forth in claim 1, wherein an overvoltage-sensitive element is arranged within the protective element, with the overvoltage-sensitive element being connected on one side electrically to the fuse element between the first contact of the protective element and the constriction, and with the other side of the overvoltage-sensitive element being in proximity of the fuse element and near to but electrically insulated from the third contact.

8. The overvoltage protection device as set forth in claim 6, wherein in addition to the overvoltage-sensitive element, lowpass-forming elements are made available.

9. The overvoltage protection device as set forth in claim 6, wherein the overvoltage-sensitive element is arranged in a pressure-tight housing.

10. The overvoltage protection device as set forth in claim 1, wherein the fuse element and the third contact of the protective element are electrically separated in a normal operating state by an insulating material, in which case the third contact and the insulating material are arranged such that an ignition near the insulating material results in an at least superficial degradation of the insulating material, whereby a surface loses its insulating property and allows current to flow between the fuse element and the third contact.

11. The overvoltage protection device as set forth in claim 10, wherein the insulating material has a plastic or a composite material with a low CTI value and includes polyether ether ketone, polyimide, or epoxy resin-filled glass fiber composite materials.

12. The overvoltage protection device as set forth in claim 1, wherein the protective element has a filling made of sand at least in proximity of the constriction.

13. An overvoltage protection device for multi-conductor systems having several overvoltage protection devices as set forth in claim 1.

14. The overvoltage protection device as set forth in claim 1, wherein the first rating corresponds to an $^{8}/_{20}$μs current wave with an amplitude of about 20 kA.

* * * * *